US008210492B2

(12) United States Patent
Serrano Rodriguez

(10) Patent No.: US 8,210,492 B2
(45) Date of Patent: Jul. 3, 2012

(54) METAL FORMWORK WITH ACCESSORIES FOR MOLDING CONCRETE

(76) Inventor: Gustavo Serrano Rodriguez, Bogota (CO)

( * ) Notice: Subject to any disclaimer, the term of this patent is extended or adjusted under 35 U.S.C. 154(b) by 666 days.

(21) Appl. No.: 10/579,476

(22) PCT Filed: Sep. 24, 2004

(86) PCT No.: PCT/IB2004/003306
§ 371 (c)(1),
(2), (4) Date: Jul. 26, 2007

(87) PCT Pub. No.: WO2005/047623
PCT Pub. Date: May 26, 2005

(65) Prior Publication Data

US 2008/0128582 A1 Jun. 5, 2008

(30) Foreign Application Priority Data

Nov. 13, 2003 (CO) ..... 03-100558

(51) Int. Cl.
*E04G 9/00* (2006.01)
*E04G 11/00* (2006.01)
*E04G 17/00* (2006.01)

(52) U.S. Cl. ..... 249/45; 249/192; 249/33

(58) Field of Classification Search ..... 249/26, 249/33, 44, 47, 194, 192, 45
See application file for complete search history.

(56) References Cited

U.S. PATENT DOCUMENTS

| | | | | | |
|---|---|---|---|---|---|
| 1,300,436 | A * | 4/1919 | McKay | 249/193 |
| 1,963,985 | A * | 6/1934 | Garrett | 249/190 |
| 1,970,547 | A * | 8/1934 | Anderson | 249/45 |
| 2,017,553 | A * | 10/1935 | Troiel | 249/19 |
| 2,151,210 | A * | 3/1939 | Jennings | 249/195 |
| 2,442,292 | A * | 5/1948 | Hart | 249/47 |
| 2,535,277 | A * | 12/1950 | Fama | 249/34 |
| 2,618,039 | A * | 11/1952 | Hyre | 249/22 |
| 2,641,043 | A * | 6/1953 | Martin | 249/192 |
| 2,693,628 | A * | 11/1954 | Hummel | 249/219.1 |
| 2,782,483 | A * | 2/1957 | De Canio | 249/219.2 |
| 2,782,484 | A * | 2/1957 | De Canio | 249/219.2 |
| 2,963,763 | A * | 12/1960 | Le Cluyse | 249/190 |
| 2,964,294 | A * | 12/1960 | Imonetti | 254/29 A |
| 3,414,228 | A * | 12/1968 | Jennings | 249/18 |
| 3,930,633 | A * | 1/1976 | Wolf | 249/1 |
| 3,995,825 | A * | 12/1976 | Ward et al. | 249/41 |
| 5,078,360 | A * | 1/1992 | Spera | 249/26 |
| 5,833,873 | A * | 11/1998 | Adonetti | 249/47 |
| 5,975,482 | A * | 11/1999 | Wu et al. | 249/18 |
| 6,279,285 | B1 * | 8/2001 | Kubica | 52/426 |
| 6,361,014 | B1 * | 3/2002 | Lopez | 249/45 |
| 6,502,802 | B2 * | 1/2003 | Jorn et al. | 249/194 |
| 6,581,898 | B2 * | 6/2003 | McCracken | 249/189 |

* cited by examiner

*Primary Examiner* — Darnell Jayne
*Assistant Examiner* — Timothy M Ayres
(74) *Attorney, Agent, or Firm* — Hoglund & Pamias, P.S.C.; Roberto J. Rios

(57) ABSTRACT

The metallic formwork system of the invention is used for concrete molding in constructions, by virtue of a diversity of metallic accessories that allow interconnection between metallic formwork modules providing a versatile, easy-to-use and portable system.

14 Claims, 8 Drawing Sheets

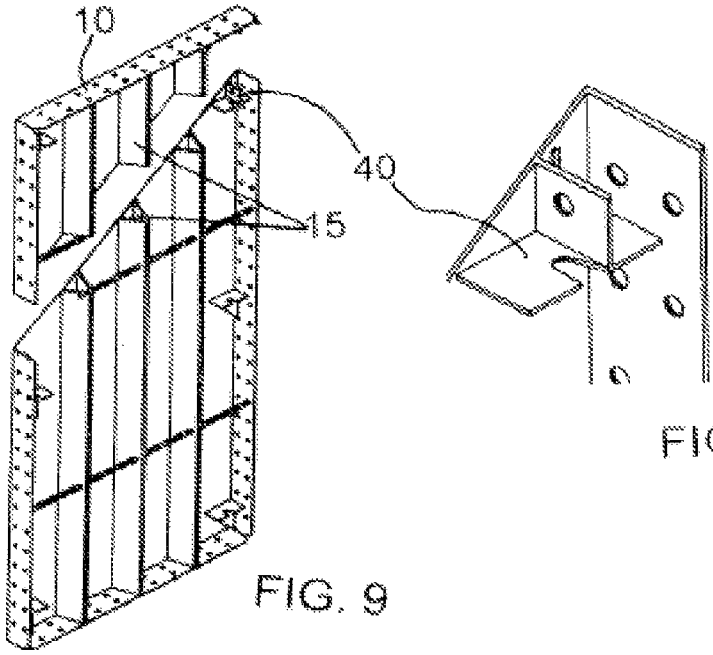
FIG. 12
FIG. 9
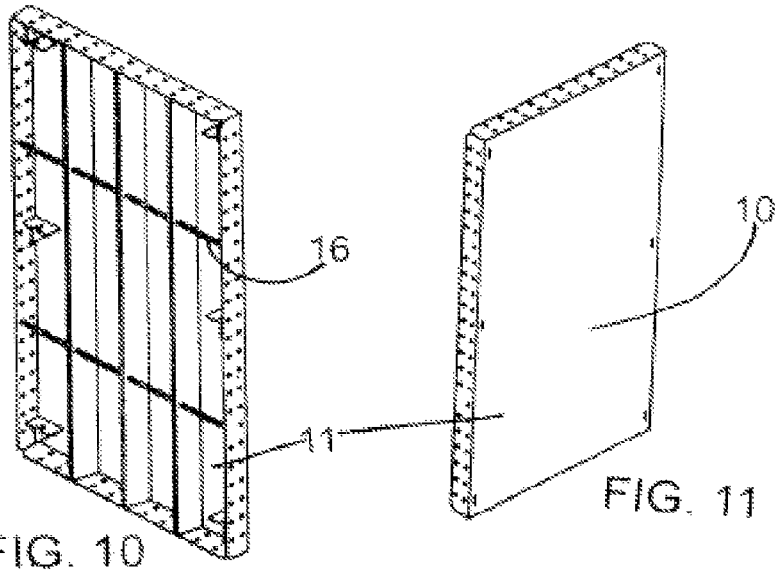
FIG. 11
FIG. 10

METAL FORMWORK WITH ACCESSORIES FOR MOLDING CONCRETE

This application is a 371 of PCT/IB2004/003306 filed on Sep. 24, 2004.

FIELD OF THE INVENTION

The present invention relates to a metallic formwork used for molding concrete in construction works and substructures. Specifically, the invention is easily operated and suitable for many uses within a modular environment that allows interconnection through a range of metallic accessories. More specifically, these metallic formworks are modules formed from steel sheets with reinforcements having dimensions according to any desired requirements. The formworks of the present invention are selectively positioned and interconnected adjacent to each other to selectively shape concrete in walls or partition walls.

The formwork of the present invention is made from steel sheets (2 mm to 3 mm thick) and the modules formed therefrom can have a weight of up to 43 kg and dimensions varying from 5 cm to 80 cm in width and 20 cm to 240 cm in height, with increasing scales of 5 cm among different sizes.

SUMMARY OF THE INVENTION

The metallic formwork of the present invention is a lightweight, portable and easy to use system. The basic module of the system is designed to weight not more than 25 Kg, although modules having dimensions of 240 cm×60 cm can weight up to 43 kg and still be easily handled by any person.

According to an aspect of the invention, the metallic formwork modules provide a visible smooth finish or texture to the concrete walls.

According to another aspect of the invention, the metallic formwork modules can be built in different sizes with different measurements to provide irregular-sized modules when needed.

In accordance to a further aspect of the invention, the metallic formwork modules are manually installed without the need of expensive and heavy equipment and crane towers.

According to one aspect of the invention, the system is easily transported to the construction site due to its box-like configuration.

According to an aspect of the invention, the metallic formwork modules are designed in accordance to earthquake resistant regulations.

According to a further aspect of the invention, the system avoids unwanted waste materials and debris.

According to another aspect of the invention, the system allows controlling the use of construction tools and materials.

According to a still further aspect of the invention, the system is designed to be re-used due to its metallic construction.

In accordance to an aspect of the invention, the metallic formwork system reduces construction costs and storage space.

According to another aspect of the invention, the versatility of the system allows it to be used in residential and commercial sites.

According to one aspect of the invention, the metallic formwork modules can be easily washed and cleaned after being used.

BRIEF DESCRIPTION OF THE DRAWINGS

These and other aspects and advantages of the formwork of the present invention are more apparent from the following detailed description and claims, particularly when considered in conjunction with the accompanying drawings, in which:

FIG. 9 shows a formwork module having V-shaped reinforcing metallic elements according to the invention;

FIG. 10 shows a perspective view of a formwork module's back surface having V-shaped reinforcing metallic elements according to the invention;

FIG. 11 shows another perspective view of a formwork module's front flat surface according to the invention; and FIG. 12 shows a fixed securing element according to the invention.

DETAILED DESCRIPTION OF THE INVENTION

Figure 1:
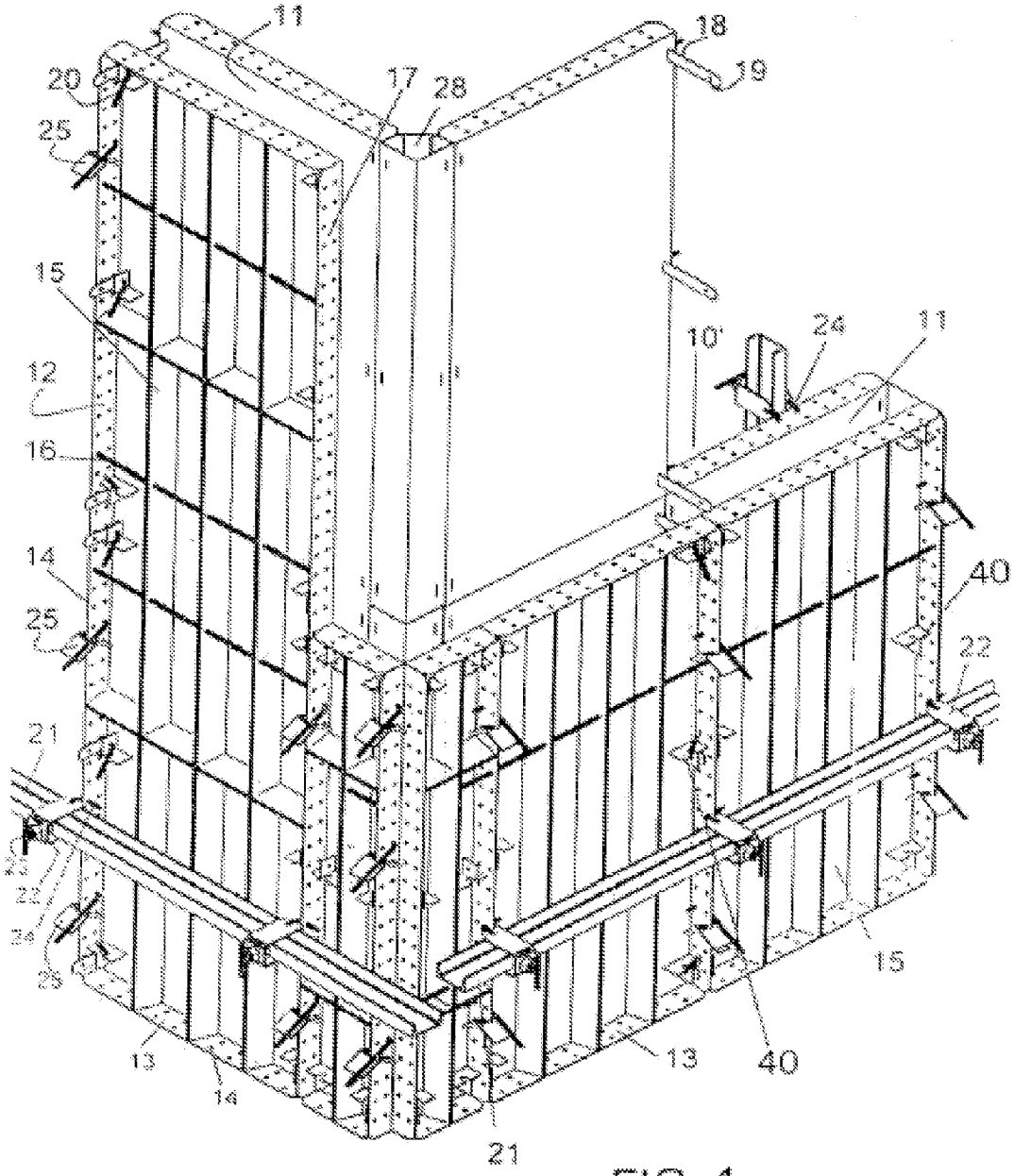
FIG. 1 shows the basic arrangement of the metallic modules forming the formwork according to the invention.
Figure 5:
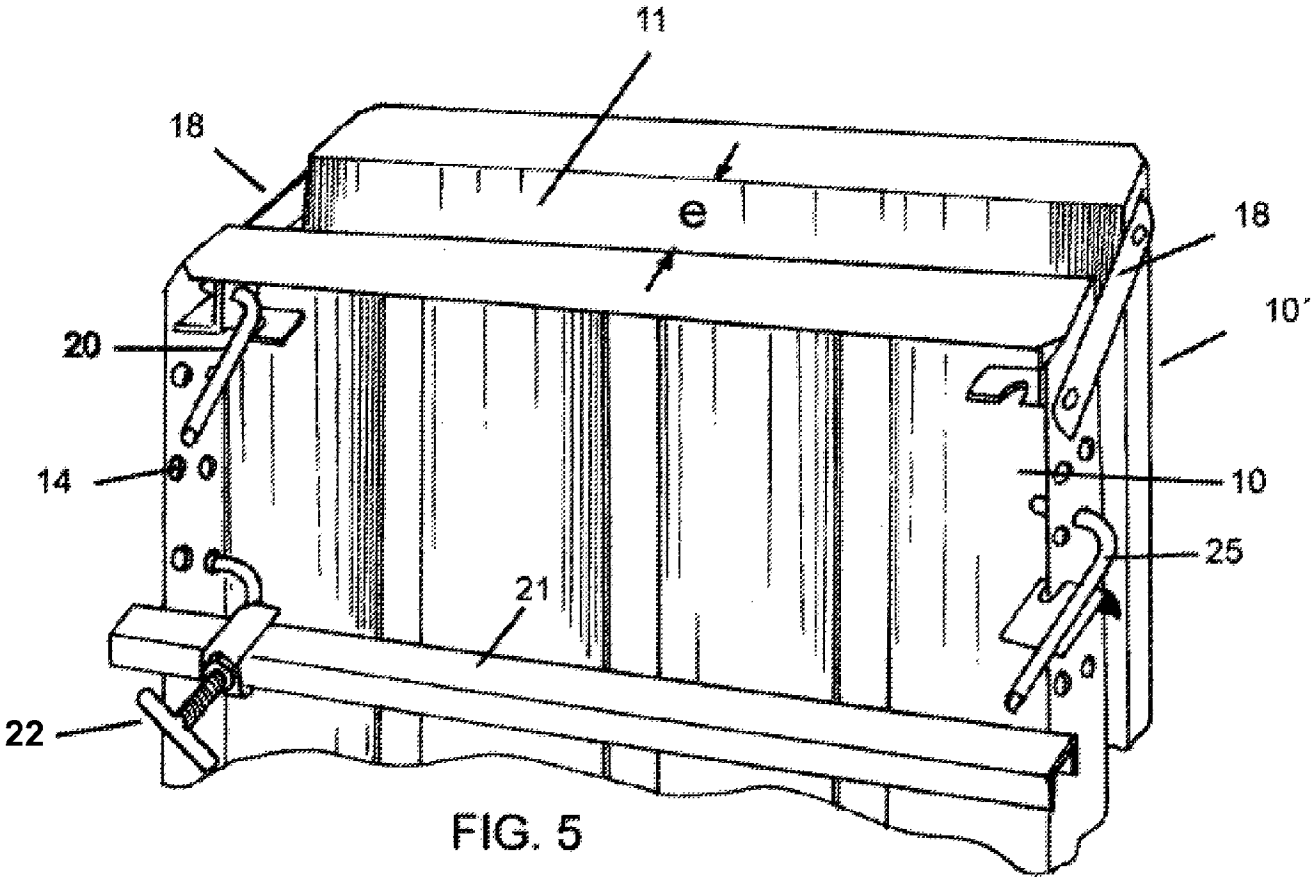
FIG. 5 shows an exemplary formwork arrangement having formwork modules in parallel according to the invention.
Figure 6:
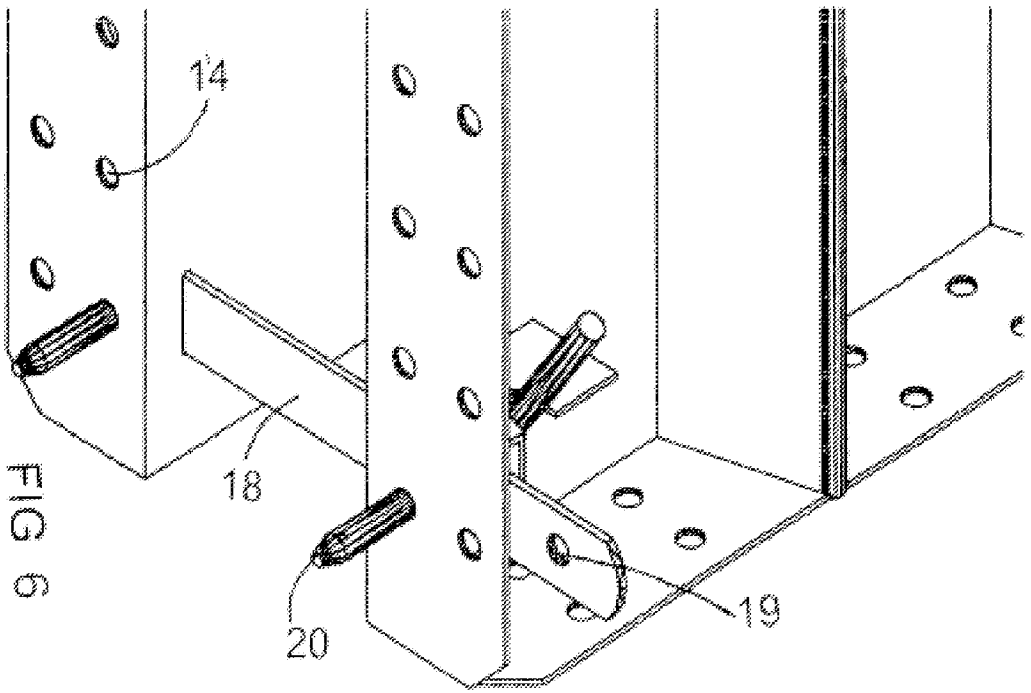
FIG. 6 shows formwork modules in parallel separated by a distancing element according to the invention.

FIG. 1 shows a metallic formwork arrangement according to the present invention. A modular frame 10 comprises a rectangular-shaped steel sheet 11 longitudinally surrounded on its sides by metallic side members 12 and on its top and bottom sides by metallic top and bottom members 13, respectively as shown in FIG. 11. Angular cuts are formed at the corners of said modular frame 10 where an end of a metallic side member 12 meets an end of a metallic member 13 as shown in FIGS. 1, 5 and 6.

Each metallic side member 12 comprises a plurality of equally spaced holes 14 across its length. The modular frame 10 is reinforced with V-shaped metallic reinforcing elements 15 extending from the top side to the bottom side as shown in FIG. 9. It is further reinforced with struts longitudinally extending from side to side and perpendicular to said V-shaped metallic reinforcing elements 15 as shown in FIGS. 1 and 10.

Figure 2:
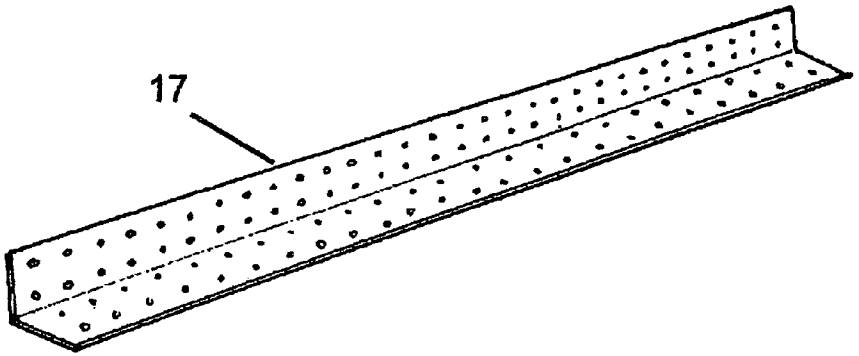
FIG. 2 shows an L-shaped angular metallic accessory that allows external turn between adjacent modules according to the invention.

FIG. 2 shows an L-shaped angular accessory 17 having an angular profile. This accessory acts as a coupling element that allows angular interconnection between external formwork modules to form concrete corners as shown in FIG. 1. L-shaped accessory 17 is a metallic accessory having the same length as the formwork module 10 and also comprises a plurality of equally spaced holes on its sides and distributed across its length.

Figure 3:
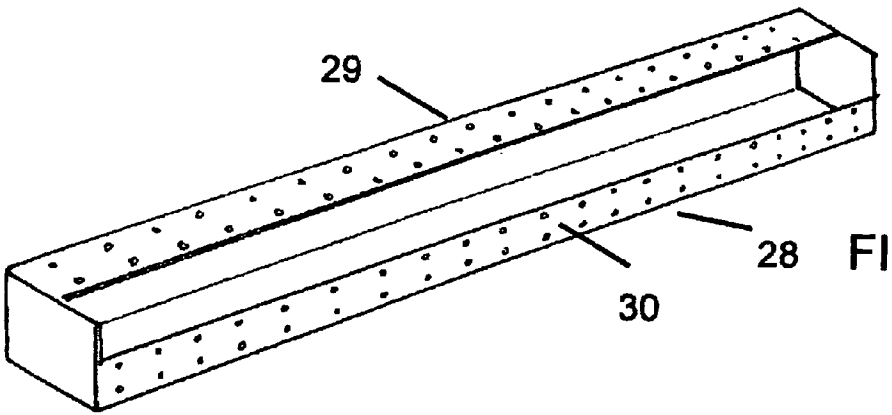
FIG. 3 shows a corner cupboard-type box accessory that allows internal turn between adjacent modules according to the invention.

FIG. 3 shows another metallic formwork accessory of the present invention. An internal corner element 28 comprises a box-type metallic frame that allows angular interconnection between internal formwork modules to form concrete corners as shown in FIG. 1. The corner element 28 has metallic walls 29 and 30 comprising a plurality of equally spaced holes on its surfaces and distributed across its length to facilitate passage of pins as will be shown later.

Figure 4:
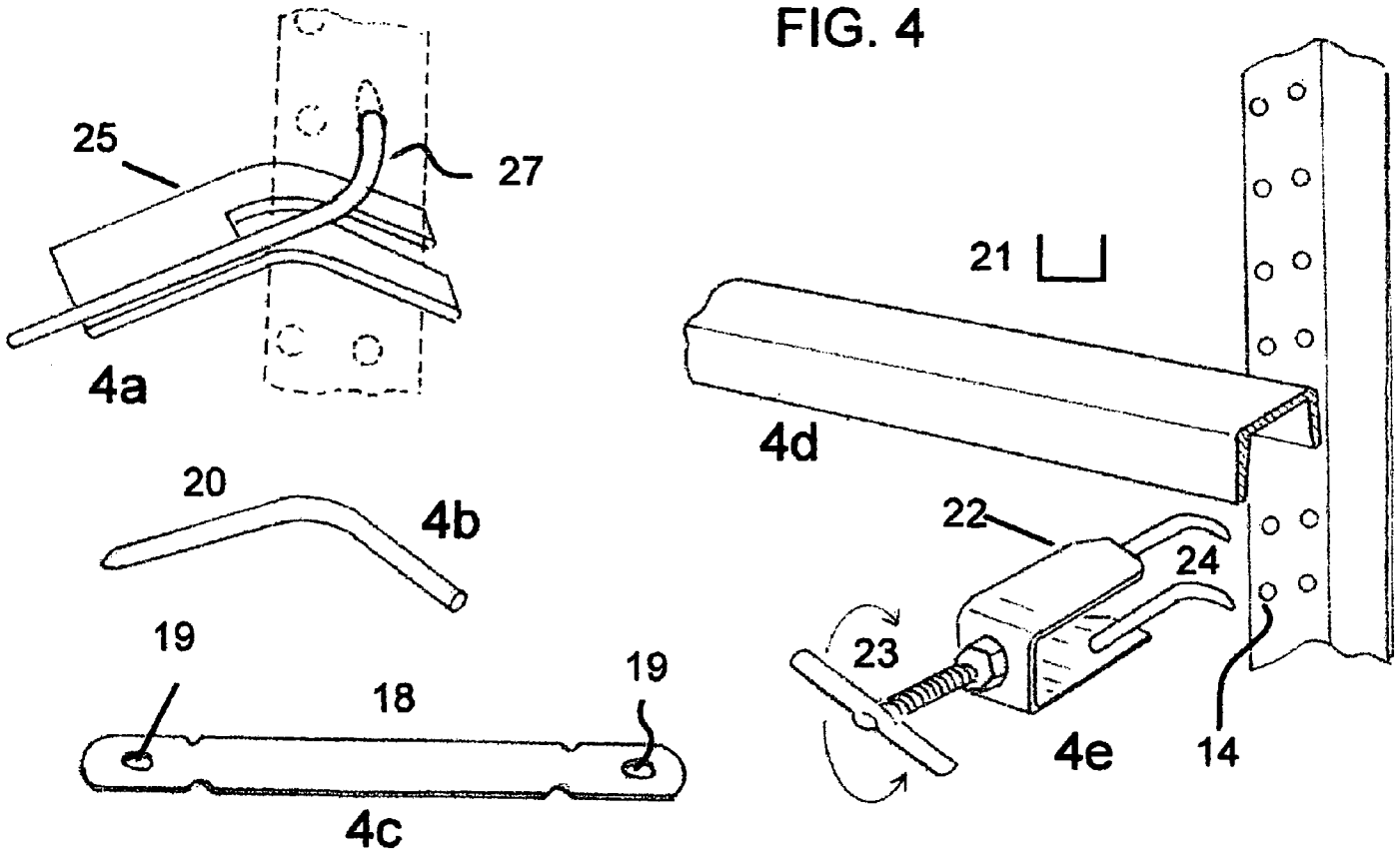
FIG. 4 (*a-e*) shows a plurality of metallic accessories used to assemble the formwork according to the invention.

The metallic formwork arrangement of the invention comprises formwork modules connected in parallel and having a distance e between the parallel-connected modules as shown in FIG. 5, where the space provided by distance e is filled with concrete to form walls or partition walls in a building or structure. These parallel-connected modules are coupled and secured to each other by distancing elements 18 shown in FIG. 4*c*, made of metallic sheet from 5 cm to 120 cm and having on its ends holes 10 (10 mm diameter) that allow tight passage of a rod-shaped hook or pin 20 having an angular folded end as shown in FIG. 4*b*. As previously mentioned, this distancing element 18 selectively regulates the space between two parallel-connected modules.

Figure 7:
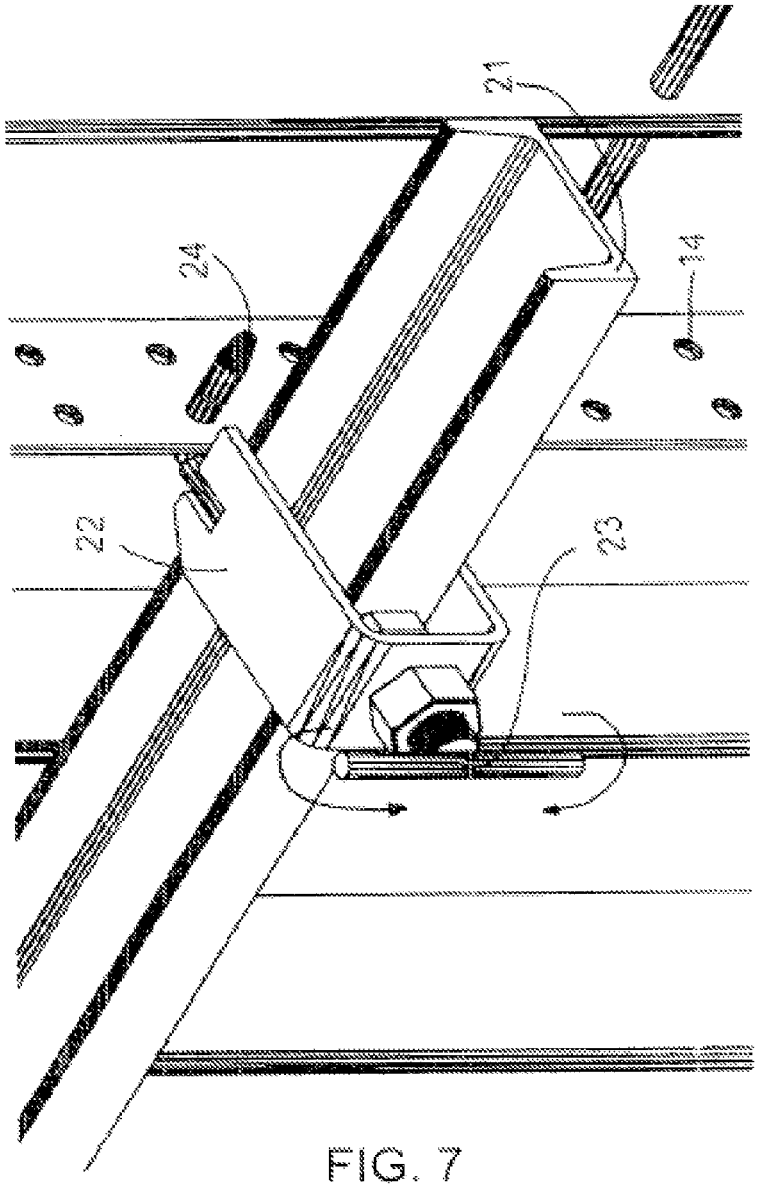
FIG. 7 shows a formwork module aligning arrangement according to the invention.

Once two modules are installed, an alignment element 21 comprising a metallic U-shaped element of variable length is provided to vertically align the modules and provide structural stability and rigidity to the same as shown in FIGS. 4*d* and 5. A U-shaped gripping press 22 shown in FIG. 4*e*, is used to longitudinally secure said alignment element 21 against the width of said metallic formwork modules as illustrated in FIGS. 1 and 5. The gripping press 22 comprises a manually-rotated screw 23 structurally coupled to said press 22 and a pair of metallic hooks 24 extending away from said gripping press 22 as shown in FIG. 4*e*. In operation, the U-shaped alignment element 21 is placed inside the U-shaped gripping press 22 and then hooks 24 are inserted into holes 14 provided on metallic side members 12. When the screw 23 is rotated, alignment element 21 is pressed against the metallic formwork modules as shown in FIGS. 1, 5 and 7.

Figure 8:
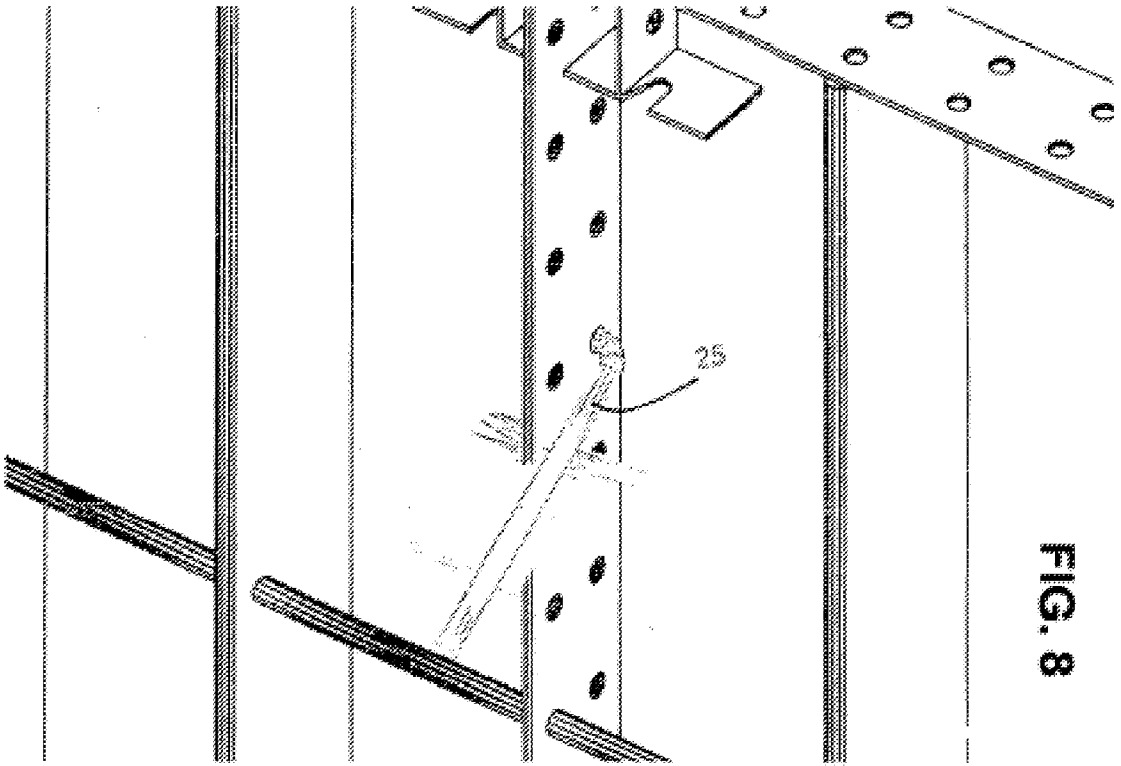
FIG. 8 shows a joining element securing adjacent formwork modules according to the invention.

Laterally-adjacent modules are complementary secured to each other by a linking element 25 shown in FIG. 4*a*, comprising a rectangular metallic sheet having an axial receiving slot. The linking element 25 has an angular folding configuration and further comprises a welded rod 27 having a folded end. When two modules are positioned side-by-side, their respective metallic side members 12 being in close proximity to each other are inserted into the axial receiving slot and rod 27 is inserted into holes 14 to secure the modules against each other as shown in FIG. 8.

As shown in FIGS. 1, 5, 6 and 12, a locking element 40 is fixedly provided on the corners of the formwork modules for receiving and securing a pin 20 used to secure the distancing element 18 to said formwork modules. Specifically, the locking element 40 is provided with a slot for receiving and latching a folded end of said pin 20. The other end of pin 20 is simultaneously inserted into hole 19 of said distancing element 18 and hole 14 of said side member 12 as shown in FIG. 6. This locking arrangement ensures that the concrete remains inside the parallel-connected formwork modules when the concrete is being molded.

The metallic formwork modules of the present invention can be manually installed in accordance to the following general steps:

1. Apply a demoulding material to the surfaces of the modules;
2. Assemble the formwork modules in accordance with the construction requirements;
3. Install and secure the L-shaped angular accessory 17 to adjacent modules as needed;
4. Install the linking elements 25 ensuring the metallic side members 12 are inserted into the axial receiving slot and that rod 27 is inserted into holes 14 to secure the modules against each other;
5. Install the distancing elements 18 to position the formwork modules in parallel by inserting one end of pin 20 into holes 19 of the distancing elements and securing the other end of the pin 20 with the locking element 40; and
6. Adjusting alignment element 21 against the formwork modules with the gripping press 22 to vertically align the modules and provide structural stability and rigidity to the same prior to pouring the concrete into the parallel-connected formwork modules arrangement.

The flat surfaces of the metallic formwork modules are coated with a demoulding material prior to pouring the concrete to prevent said concrete from adhering to said flat surfaces. The surfaces are easily pressure-washed once the concrete filing process is finished.

The rigidity and integrity of the system is ensured by the installation of pins into the appropriate holes provided for securing the distancing elements to the modules.

These modules can be made in sizes of 240 cm in height and from 5 to 80 cm in width. The internal corner modules and the L-shaped angular accessories can have lengths of from 20 to 240 cm. The formwork module's weight based on the selected dimensions can very from 3 kg (5×120 cm) to 43 kg (60×240 cm).

Because many varying and differing embodiments maybe made within the scope of the inventive concept herein taught and because many modifications may be made in the embodiment herein detailed in accordance with the descriptive requirement of the law, it is to be understood that the details herein are to be interpreted as illustrative and not in a limiting sense.

The invention claimed is:

1. A modular formwork system for concrete moulding comprising:

a formwork module comprising a rectangular metallic frame with a front surface and a back surface, top, bottom and sides elements protruding perpendicular from said back surface, wherein said elements have a plurality of holes extending along their length;

a plurality of V-shaped reinforcing elements attached to said back surface and longitudinally extending between said top element and said bottom element;

a plurality of struts elements located at said back surface, longitudinally extending between said side elements and perpendicular to said V-shaped reinforcing elements;

locking elements fixedly and longitudinally positioned on said side elements of the back surface of said formwork module and having a pass-through opening configured to receive one end of a distancing element used to provide a parallel distance between the front surface of said formwork module and the front surface of another formwork module;

a linking element configured to secure together one side element of said formwork module against one side element of another formwork module, said linking element comprises a substantially rectangular element having a top surface and a bottom surface, said rectangular element is folded at an angle and has an axially receiving slot provided on one of its sides and passing through said top and bottom surfaces, said axially receiving slot is configured to receive within and secure together the side elements of said formwork module and said another formwork module; and a L-shaped linking pin attached to the top surface of said linking element, wherein an end of said L-shaped linking pin is configured to be inserted into a hole of the plurality of holes of the side element of said framework module and into a hole of the plurality of holes of the side element of said another framework module, wherein said linking element is removably latched to said one side element of said formwork module and to said one side element of said another formwork module; and an alignment arrangement comprising an alignment element positioned against said side elements protruding perpendicular from said back surface of the formwork module and longitudinally extending between the side elements of said formwork module, and a gripping element configured to be attached to said side elements of said formwork module and to selectively push said alignment element against said side elements protruding perpendicular from the back surface of the formwork module to horizontally aligned said formwork module against other laterally-positioned formwork modules.

2. The modular formwork system of claim 1, further comprising a L-shaped angular element having a first side with a plurality of holes extending along its length and second side perpendicular to said first side with a plurality of holes extending along its length, wherein said L-shaped angular element is configured to allow two laterally-adjacent formwork modules to be connected at an angle by having a side element of a formwork module secured to said first side and having a side element of another laterally adjacent formwork module secured to said second side.

3. The modular formwork system of claim 2, wherein said linking element is configured to receive within said axially receiving slot and secure together a side element of said formwork module and said first side of the L-shaped angular element; wherein said end of said L-shaped linking pin is configured to be inserted into a hole of the plurality of holes of the side element of said framework module and into a hole of said first side of the L-shaped angular element.

4. The modular formwork system of claim 1, further comprising a rectangular-shaped internal corner element, wherein a portion of a first side has a plurality of holes extending along its length and a portion of a second side has a plurality of holes extending along its length, an opening being defined between said portions, said rectangular-shaped internal corner element is configured to allow two laterally adjacent formwork modules to be connected at an angle by having a side element of a formwork module secured to said portion of said first side and having a side element of another laterally adjacent formwork module secured to said portion of said second side.

5. The modular formwork system of claim 1, wherein each of said locking elements further comprises a receiving hole and a latching slot perpendicular to said receiving hole, an end of a L-shaped locking pin is inserted into a hole provided on said one end of the distancing element and into said receiving hole effectively securing said distancing element to said formwork module, the other end of said L-shaped locking pin is inserted into said latching slot of said locking element preventing lateral movement of said locking pin.

6. The modular formwork system of claim 1, wherein the formwork system is formed by providing at least a first and second formwork modules positioned in parallel and spaced apart by selectively locking said one end of said distancing member to said first formwork module by means of a pin and hole arrangement and selectively locking the other end of said distancing member to said second formwork module by means of another pin and hole arrangement, at least the length of said distancing member defining the space between said first and second formwork modules.

7. The modular formwork system of claim 1, wherein a demoulding material is applied to said front surface prior to pouring concrete to prevent said concrete from adhering to said flat surface.

8. A modular formwork system for concrete moulding comprising:

a formwork module comprising a rectangular metallic frame with a front surface and a back surface, top, bottom and sides elements protruding perpendicular from said back surface, wherein said elements have a plurality of holes extending along their length;

a plurality of V-shaped reinforcing elements attached to said back surface and longitudinally extending between said top element and said bottom element;

a plurality of struts elements located at said back surface, longitudinally extending between said side elements and perpendicular to said V-shaped reinforcing elements;

locking elements fixedly and longitudinally positioned on said side elements of the back surface of said formwork module and having a pass-through opening configured to receive one end of a distancing element used to provide a parallel distance between the front surface of said formwork module and the front surface of another formwork module;

a linking element configured to secure together one side element of said formwork module against one side element of another formwork module, wherein said linking element is removably latched to said one side element of said formwork module and to said one side element of said another formwork module; and an alignment arrangement comprising an alignment element horizontally positioned against said side elements protruding perpendicular from said back surface of the formwork module and longitudinally extending between the side elements of said formwork module; a U-shaped gripping element having a first flat side, bottom flat side and second flat side defining a continuous interior space within; a pair of spaced hooks, each one extending away and coplanar from said first and second flat sides respectively and having a curved end portion; and a manually-actuated pressing means, said alignment arrangement is configured to horizontally align laterally-positioned formwork modules by inserting said alignment element inside the continuous interior space of said U-shaped gripping element, inserting said pair of spaced hooks inside said plurality of holes of the side elements of said laterally-positioned formwork modules while said alignment element is inside the continuous interior space, and actuating said pressing means to push said alignment element against said side elements protruding perpendicular from the back surface of said laterally-positioned formwork modules effectively aligning horizontally said laterally-positioned formwork modules.

9. The modular formwork system of claim 8, further comprising a L-shaped angular element having a first side with a plurality of holes extending along its length and second side perpendicular to said first side with a plurality of holes extending along its length, wherein said L-shaped angular element is configured to allow two laterally-adjacent formwork modules to be connected at an angle by having a side element of a formwork module secured to said first side and having a side element of another laterally adjacent formwork module secured to said second side.

10. The modular formwork system of claim 9, wherein said linking element comprises a receiving slot configured to receive within and secure together a side element of said formwork module and said first side of the L-shaped angular element; wherein an end of a L-shaped linking pin attached to said linking element is configured to be inserted into a hole of the plurality of holes of the side element of said framework module and into a hole of said first side of the L-shaped angular element.

11. The modular formwork system of claim 8, further comprising a rectangular-shaped internal corner element, wherein a portion of a first side has a plurality of holes extending along its length and a portion of a second side has a plurality of holes extending along its length, an opening being defined between said portions, said rectangular-shaped internal corner element is configured to allow two laterally adjacent formwork modules to be connected at an angle by having a side element of a formwork module secured to said portion of said first side and having a side element of another laterally adjacent formwork module secured to said portion of said second side.

12. The modular formwork system of claim 8, wherein each of said locking elements further comprises a receiving hole and a latching slot perpendicular to said receiving hole, an end of a L-shaped locking pin is inserted into a hole provided on said one end of the distancing element and into said receiving hole effectively securing said distancing element to said formwork module, the other end of said L-shaped locking pin is inserted into said latching slot of said locking element preventing lateral movement of said locking pin.

13. The modular formwork system of claim 8, wherein the formwork system is formed by providing at least a first and second formwork modules positioned in parallel and spaced apart by selectively locking said one end of said distancing member to said first formwork module by means of a pin and hole arrangement and selectively locking the other end of said distancing member to said second formwork module by means of another pin and hole arrangement, at least the length of said distancing member defining the space between said first and second formwork modules.

14. The modular formwork system of claim 8, wherein a demoulding material is applied to said front surface prior to pouring concrete to prevent said concrete from adhering to said flat surface.

* * * * *